United States Patent [19]

Spitz

[11] Patent Number: 4,779,178

[45] Date of Patent: Oct. 18, 1988

[54] COMPACT FLUORESCENT LIGHTING APPARATUS

[76] Inventor: Russell W. Spitz, 2999 Hartley Rd., Suite 301, Bldg. C, Jacksonville, Fla. 33217

[21] Appl. No.: 123,347

[22] Filed: Nov. 20, 1987

Related U.S. Application Data

[63] Continuation-in-part of Ser. No. 865,411, May 21, 1986, Pat. No. 4,719,546.

[51] Int. Cl.[4] ..... F21K 7/00

[52] U.S. Cl. ..... 362/260; 362/220; 362/269; 362/346

[58] Field of Search ..... 362/217, 220, 221, 260, 362/269, 326, 346

[56] References Cited

U.S. PATENT DOCUMENTS

| | | | |
|---|---|---|---|
| 2,291,489 | 7/1942 | Naysmith | 362/221 X |
| 2,418,195 | 4/1947 | Rolph . | |
| 2,591,661 | 4/1952 | McCandless . | |
| 2,740,885 | 4/1956 | Kruger | 362/220 |
| 3,159,352 | 12/1964 | Wakefield et al. | 362/222 |
| 3,829,677 | 8/1974 | DeLano . | |
| 4,242,725 | 12/1980 | Douma et al. . | |
| 4,336,576 | 6/1982 | Crabtree . | |
| 4,388,675 | 6/1983 | Lewin . | |
| 4,403,275 | 9/1983 | Oser . | |
| 4,499,529 | 2/1985 | Figueroa . | |
| 4,536,830 | 8/1985 | Wisniewski | 362/346 X |
| 4,562,517 | 12/1985 | Pankin . | |
| 4,564,888 | 1/1986 | Lewin et al. . | |

*Primary Examiner*—Stephen F. Husar

*Attorney, Agent, or Firm*—Harpman & Harpman

[57] ABSTRACT

Fluorescent lighting apparatus utilizing a single elongated tubular light source replaces the multiple fluorescent tubular light sources of heretofore conventional or prior art fluorescent lighting apparatus. A very substantial part of the light output of the fluorescent tubular light source is reflected by improved silver reflectors having multiple elongated strip-like mirror surfaces. A compact, lightweight, simplified, less expensive and more efficient apparatus is disclosed wherein the improved reflector forms the principal part of the apparatus and is provided with a compact raceway longitudinally thereof functioning as a structural element and as a raceway for current carrying conductors in the apparatus. The ballast is relocated in the apparatus to contribute to the compact, economical, lightweight structure which is easily and efficiently positioned in suspended spaced relation to a ceiling for selective improved illumination of a desired area.

12 Claims, 2 Drawing Sheets

COMPACT FLUORESCENT LIGHTING APPARATUS

This is a continuation-in-part of application Ser. No. 865,411, filed 5/21/86, now U.S. Pat. No. 4,719,546.

BACKGROUND OF THE INVENTION

1. Technical Field

This invention relates to fluorescent lighting apparatus of the type utilizing elongated fluorescent tubes in or on fixtures mounted on the ceiling of an enclosure or suspended therebeneath for illuminating articles therebelow.

2. Description of the Prior Art

Prior fluorescent lighting apparatus such as used in commercial applications including retail stores and the like have generally utilized two or more fluorescent tubes positioned in side by side relation on or in a fixture comprising several elongated boxes and having a white painted reflective surface. My copening application for patent entitled 'Fluorescent Lighting Apparatus", Ser. No. 865,411, now U.S. Pat. No. 4,719,546, which patent is hereby expressly incorporated by reference herein. illustrates an improved reflector structure which is particularly suitable in the present improved lighting apparatus.

A further prior art luminaire is disclosed in U.S. Pat. No. 3,159,352 wherein an improved refractor is positioned below the fluorescent tubes in the fixture for improving the distribution of light output therefrom.

The present invention substantially improves the fluorescent lighting apparatus by incorporating the reflector of my copending patent application as the principal structural portion of the apparatus in which the fluorescent tube and reflector are positioned and substitutes a wiring raceway for the usual complicated, expensive and large ballast enclosure and efficiently and practically positions the ballast of the apparatus in any one of a number of locations adjacent the apparatus or incorporated therein which measurably contributes to the compact, lightweight structure as well as to the esthetic appearance of the improved apparatus which enables it to be installed on or in the surface of ceilings or suspended therebelow with none of the bulky objectionable visual appearance of the prior art devices and the elongated superimposed white painted boxes thereof.

SUMMARY OF THE INVENTION

The compact fluorescent lighting apparatus disclosed herein positions an elongated fluorescent tube in an elongated modified arcuate shaped supporting structure which preferably is shaped to provide a plurality of elongated transversely flat surfaces arranged in edge to edge relation and to which silver light reflecting material formed as a thin film and of very light weight can be readily attached. The elongated modified arcuate shaped supporting structure is provided with the necessary rigidity by having its longitudinal edges formed as outturned flanges and a low flat raceway secured thereto and extending coextensively therewith. The lamp hangers are attached directly to the structure of the raceway and ballasts are positioned on either the modified elongated support structure or the raceway or remotely thereto to provide the suitable energy for the fluorescent tube of the apparatus. End panels are added to the described structure to form individual elongated units which may be suspended from a ceiling or alternately to close the ends of a series of the compact fluorescent lighting apparatus arranged in end to end relation.

DESCRIPTION OF THE PREFERRED EMBODIMENT

Figure 1:
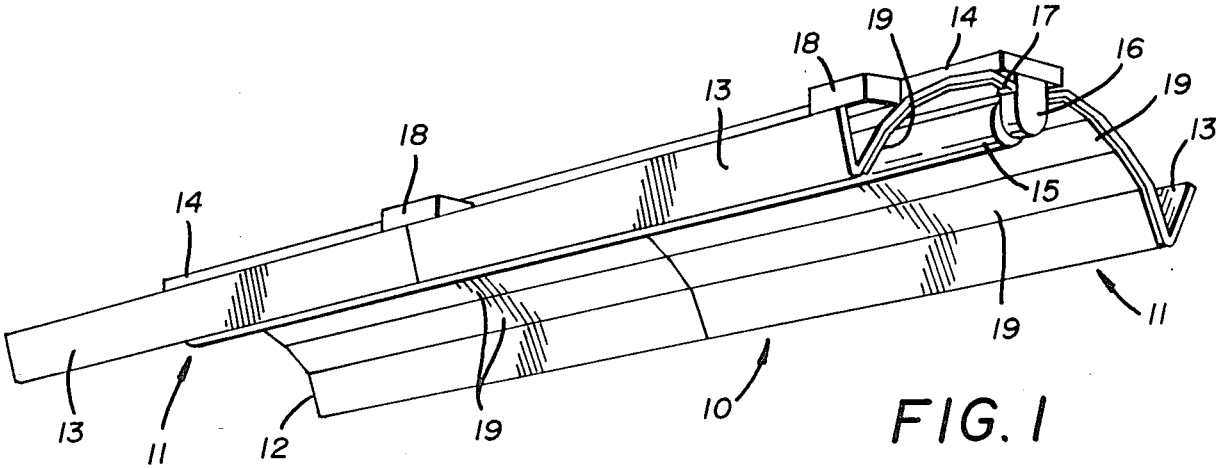
FIG. 1 is a perspective elevation of a strip arrangement of the compact fluorescent lighting apparatus arranged for attachment to a ceiling.

By referring to the drawings and FIG. 1 in particular, a perspective elevation of the compact fluorescent lighting apparatus of the present invention arranged to form a strip fixture may be seen to comprise a pair of elongated curvature shaped support structures 10 positioned in end to end relation and having open ends 11. Each of the elongated modified curvature shaped support structures is preferably formed of relatively thin lightweight material shaped to form a plurality of longitudinally extending transversely flat sections 12 with outturned oppositely disposed flanges 13 defining the longitudinal edges of the elongated support structure. In the exemplary embodiment shown in FIG. 1, flanges 13 extend upwardly a distance at least one half of the height of the curved shaped structure. Low transversely and longitudinally flat members 14 are attached to the outer upper surfaces of the elongated modified arcuate shaped support structures 10 to add desired rigidity thereto and to provide raceways for wires supplying current to fluorescent tubes 15 positioned in light hangers or tube holders 16 which are attached to the longitudinal members 14. The tube holders 16 register with notches 17 in the ends of the elongated modified arcuate shaped support structures 10. Box-like enclosures 18 are attached to the members 14 by conduits so that ballasts and the enclosures 18 can communicate with conductors in the raceways formed by the members 14 which connect with the tube hangers 16 and the fluorescent tube 15 as will be understood by those skilled in the art.

It will be observed that the enclosures 18 are relatively small and that they are located alongside the members 14 forming the raceways so that the uppermost surfaces of the enclosures 18 and the members 14 lie on the same horizontal plane. Those skilled in the art will observe that the simple, compact fluorescent lighting apparatus thus disclosed can be simply and easily attached to an overhead support such as a suspended ceiling or the like and that the structure is such that the overall height of the apparatus is less than the overall width so that the compact apparatus when viewed from below presents an attractive appearance.

Still referring to FIG. 1 of the drawings, it will be seen that a highly efficient light reflective silver material 19 is affixed to the inner opposed surfaces of the elongated modified arcuate structures 10 so as to conform with the plurality of longitudinally extending transversely flat sections 12 preferably formed therein. In the event the elongated modified arcuately shaped support structures 10 are not so formed, the reflective material 19 is formed in a plurality of longitudinally extending transversely flat sections surrounding the fluorescent tube 15, the sections being arranged in a manner disclosed in my hereinbefore mentioned co-pending patent application Ser. No. 865,411, now U.S. Pat. No. 4,719,546 so that all of the light of the fluorescent tube 15 is directed away therefrom and downwardly and outwardly of the opening defined by the longitudinally extending outturned flanges 13, the arrangement being such that when the compact fluorescent lighting apparatus of the present invention is viewed from below, the single fluorescent tube appears as a number of parallel fluorescent tubes of equal brilliance due to the positioning and arrangement of the transversely flat sections of the reflective material 19 which reflect substantially 95% of the light of the fluorescent tube 15 downwardly from the apparatus as compared with the prior art white painted box-like fixtures which reflect approximately 5% of the light of the fluorescent tube downwardly.

Figure 2:
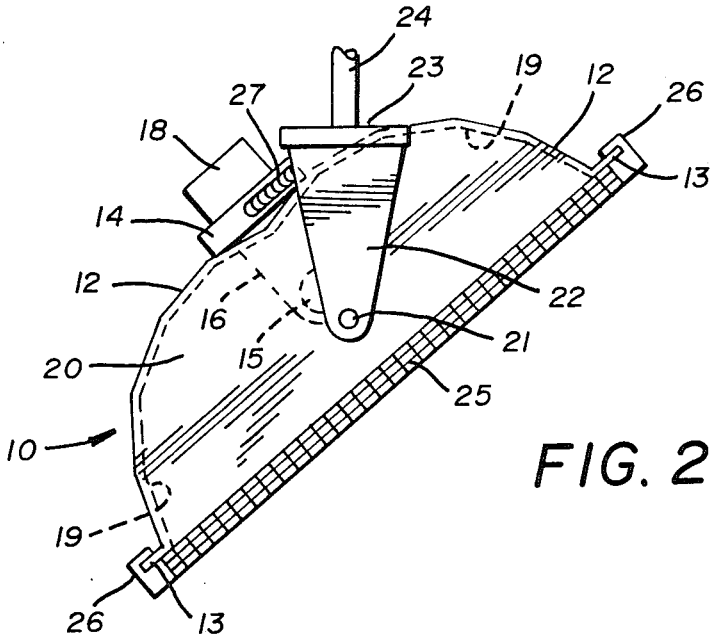
FIG. 2 is an end elevation of a form of the compact fluorescent lighting apparatus having end panels and pivotally attached support means.

By referring now to FIG. 2 of the drawings, one or more of the elongated modified curvature shaped support structures 10 may be seen to be provided with end panels 20 in which projecting support and pivot members 21 are positioned for registry with openings in vertically disposed brackets 22 which are secured at their uppermost ends to cross members 23 which in turn are carried on vertical supports 24.

The longitudinally extending low flat member 14 is illustrated in FIG. 2 as carrying the enclosure 18 thereon and broken lines indicate the positions of the tube holders 16 and fluorescent tube 15.

Still referring to FIG. 2 of the drawings, a refractor lens 25 is illustrated positioned across the opening defined by the elongated modified arcuately shaped supporting structure 10 and having upturned and inturned longitudinal edge configurations 26 at least one of which is movable engaged on the oppositely disposed outturned longitudinally extending flanges 13 of the elongated modified arcuately shaped supporting structures 10. The refractor 25 comprises a lens that breaks up the multiple reflections of the fluorescent tube 15 reflected by the reflective material 19 as described in connection with FIG. 1 of the drawings, which is present on the insides of the elongated curvature shaped support structures 10 so that the appearance of the fixture, particularly when titled from vertical as shown in FIG. 2 of the drawings is that of an even, relatively wide, softly glowing surface rather than the aforesaid plurality of bright longitudinally extending reflections of the fluorescent tube 15.

Figure 3:
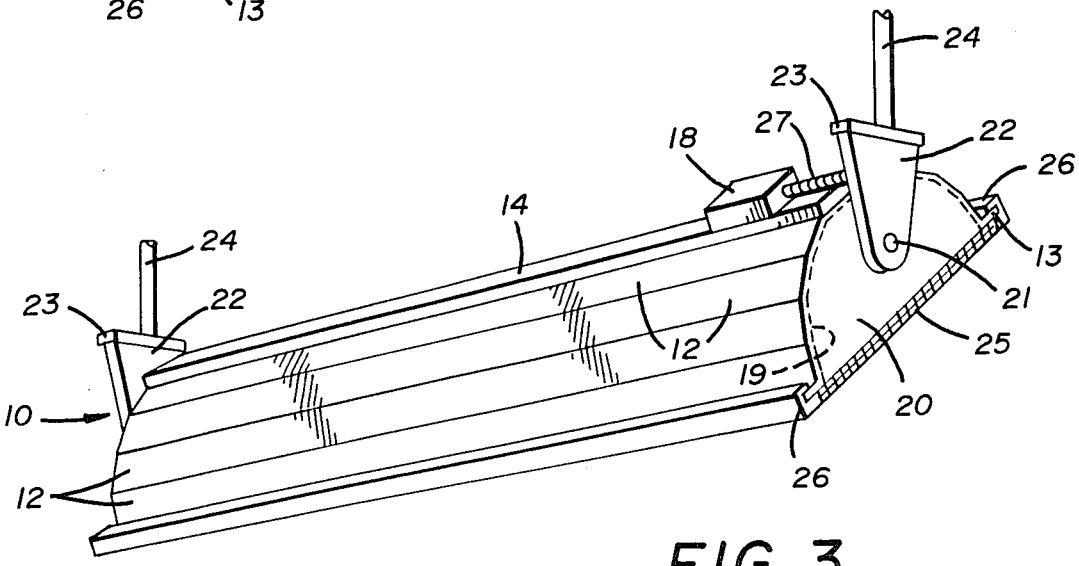
FIG. 3 is a perspective elevation of a secton of the compact fluorescent lighting apparatus of FIG. 2.

By referring now to FIG. 3 of the drawings, a single elongated curvature shaped supporting structure 10 tilted at an angle from horizontal may be seen to incorporate the end plates 20, support brackets 22 and vertical supports 24 as hereinbefore referred to in connection with FIG. 2 of the drawings. The longitudinally extending low flat member 14 is hollow and is illustrated as extending between the end plates 20 and attached to the elongated curvature shaped support structure 10 so as to form a structure that is self-supporting in its longitudinal position so as to retain its desirable shape. The enclosure 18 is positioned on the structure 14 which also forms the raceway as hereinbefore described and as seen in FIG. 3 a conduit 27 which is flexible extends to one of the vertically positioned brackets 22 and extends therealong to communicate with the interior of the vertical support 24 so that electrical conductors from a power source may be accommodated.

A principal point of novelty in the present disclosure is the positioning of the tube holders on the longitudinally extending low flat members 14 which define the raceways whereby the weight of the fluorescent tube 15 and the tube holders 16 are carried at points adjacent the ends of the apparatus and the means supporting the apparatus.

Figure 4:
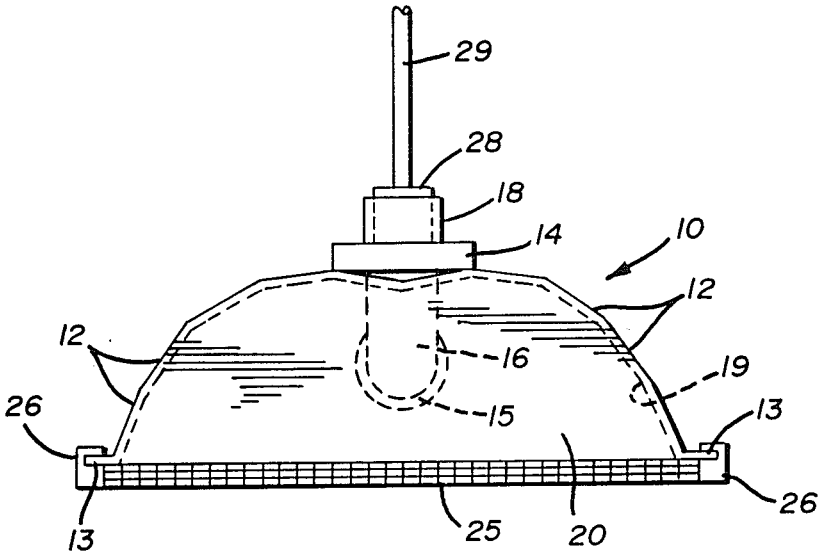
FIG. 4 is an end elevation of the compact lighting apparatus supported by vertical support members.

Those skilled in the art will observe that the compact fluorescent lighting apparatus disclosed herein may be advantageously positioned in spaced horizontal relation to the ceiling or other supporting surface and by referring to FIG. 4 of the drawings, such an arrangement may be seen to comprise one or more of the elongated modified arcuately shaped support structures 10, at least two of which are provided with end plates 20. Support boxes 28 are positioned on and attached to the longitudinally extending low flat members 14 of the apparatus and they in turn engage the lower ends of vertical tubular supports 29 so that the compact fluorescent lighting apparatus comprises a rigid assembly of the elongated modified arcuately shaped supporting structure 10, the longitudinally extending low flat members 14 secured thereto longitudinally thereof, the support boxes 28 and the vertical tubular supports 29. This form of the invention as disclosed carries the tube holders 16 directly on the longitudinally extending low flat members 14 and the fluorescent tube 15 is supported by the tube holders 16. If desired, the open bottom of the elongated modified arcuately shaped support structure 10 defined by the oppositely disposed outturned longitudinally extending flanges 13 may be provided with a refractor 25 such as hereinbefore referred to, the longitudinal edges of which are formed as upturned and inturned configurations registrable with outturned modified flat flanges 13.

Those skilled in the art will observe that the improved compact fluorescent lighting apparatus of the present invention enables supermarkets and other retail establishments that depend on fluorescent lighting to achieve improved lighting and at the same time reduce the costs of that lighting, both maintenance and energy costs, more than 50% from the conventional costs now common.

Those skilled in the art will also observe that by utilizing the compact fluorescent lighting apparatus of the present invention with available color corrected fluorescent tubes greatly improved lighting with respect to meat counters and the like is obtained due to the even distribution of light from one or more units of the improved compact fluorescent lighting apparatus. The improved even illuminatiion is achieved at greatly reduced energy costs compared with the heretofore customary incandescent spotlights.

Those skilled in the art will observe that the compact fluorescent lighting apparatus disclosed herein is less expensive to produce, less expensive to install and operates at at least a 50% reduction in energy costs compared with the heretofore commercial fluorescent fixtures. The compact structure lends itself to relatively inexpensive surface mounting on ceilings and makes possible the positioning of one or more units of the compact fluorescent lighting apparatus in depending relation to a ceiling which greatly facilitates the illumination of the particular merchandise locations which have heretofore had to be illuminated with incandescent spotlights. Some of such depending fixture installations are advantageously equipped with refractor lenses which eliminate the visual appearance of multiple bright strips of light produced by the compact fluorescent lighting apparatus without reducing the actual lumens delivered to the merchandise therebelow.

It will thus be seen that the various forms of the improved compact fluorescent lighting apparatus disclosed herein serve to improve lighting efficiency and to improve energy economy.

While preferred embodiments of the apparatus according to the invention have been described in the specification and shown in the drawings, many modifications thereof may be made by persons skilled in the art without departing from the spirit of the invention and it is intended to protect by Letters Patent all forms of the invetnion falling within the scope of the following claims.

Having thus described my invention what I claim is:

1. In fluorescent lighting apparatus of the type having one fluorescent tube and elongated structures supporting the same, an improved fluorescent lighting apparatus, the improvement comprising: a compact lightweight elongated structure formed in a curvature having the form of a wide arch positioned radially of and partially surrounding said fluorescent tube and defining an elongated downward facing wide opening of a known width, an elongated hollow structure positioned on the upper surface of said elongated structure formed in a curvature for reinforcing said elongated structure formed in a curvature and for providing a raceway for current conductors, light hangers on said hollow structure supporting said fluorescent tube and light reflector means on the inside of said elongated structure formed in a curvature, said light reflector means formed in a plurality of elongated planar sections of light reflective material, said fluorescent tube being centrally positioned with respect to said light reflector means, said planar sections being angularly disposed to reflect light from said fluorescent tube in a direction away from said fluorescent tube and outwardly and downwardly through said wide downward facing opening whereby said reflected light is distributed in substantially equal amounts across the width of said opening and whereby said fluorescent lighting apparatus appears to have a light source of a width equal to the known width of said downward facing opening.

2. The improvement in fluorescent lighting apparatus set forth in claim 1 wherein outturned upwardly angled longitudinal flanges on said elongated structure define said downward facing opening.

3. The improvement in fluorescent lighting apparatus set forth in claim 1 wherein said elongated structure is of a known height and wherein outturned upwardly angled longitudinal flanges on said elongated structure define said downward facing opening, said flanges extending upwardly a distance at least one half the known height of said elongated structure.

4. The improvement in fluorescent lighting apparatus set forth in claim 1 wherein said elongated sections of light reflecting material comprise parallel arcuately angularly disposed flat reflective segments of a continuous reflector means.

5. The improvement in fluorescent lighting apparatus set forth in claim 1 wherein a box-like enclosure for a ballast is positioned on said elongated structure.

6. The improvement in fluorescent lighting apparatus set forth in claim 1 and wherein said light reflector means is an integral sheet-like body comprising a segmented curved shape having parallel flat surfaces forming said elongated planar sections.

7. The improvement in fluorescent lighting apparatus set forth in claim 1 wherein end panels are secured to said elongated structure at the ends thereof and pivot means is positioned on said end panels and support means engage said pivot means for adjustably positioning said fluorescent lighting apparatus with respect to said support means.

8. In fluorescent lighting apparatus of the type having one fluorescent tube and elongated structures supporting the same, an improved fluorescent lighting apparatus, the improvement comprising: a compact lightweight elongated structure formed in a curvature having the form of a wide arch with a plurality of elongated transversely flat panels positioned radially of and partially surrounding said fluorescent tube and defining an elongated downward facing wide opening of a known width, an elongated hollow body member positioned on the upper surface of said elongated structure formed in a curvature for reinforcing said elongated structure formed in a curvature and providing an enclosure for current conductors, light hangers on said hollow body member for supporting said fluorescent tube and elongated light reflector means positioned directly on the inside of said elongated structure formed in a curvature, said light reflector means having a plurality of elongated planar sections registering with said elongated transversely flat panels, said planar sections being angularly disposed to reflect light from said fluorescent tube in a directiion away from said fluorescent tube and outwardly and downwardly through said wide downward facing opening whereby said reflected light is distributed in substantially equal amounts across the width of said downward facing opening and whereby said fluorescent lighting apparatus appears to have a light source of a width equal to the known width of said downward facing opening.

9. The improvement in fluorescent lighting apparatus set forth in claim 8 wherein said plurality of elongated planar sections have reflective surfaces of high reflective efficiency.

10. The improvement in fluorescent lighting apparatus set forth in claim 8 wherein said elongated planar sections comprise parallel arcuately angularly disposed flat reflective segments of a continuous flexible sheet-like reflector body.

11. The improvement in fluorescent lighting apparatus set forth in claim 8 wherein said elongated light reflector means is an integral body member forming said plurality of elongated planar sections.

12. The improvement in fluorescent lighting apparatus set forth in claim 8 wherein said elongated light reflector means is an integral body member comprising a segmented curved structure having parallel flat surfaces forming said elongated planar sections.

* * * * *